US009632454B2

(12) United States Patent
Nagata

(10) Patent No.: US 9,632,454 B2
(45) Date of Patent: Apr. 25, 2017

(54) CARTRIDGE AND IMAGE FORMING APPARATUS

(71) Applicant: Sharp Kabushiki Kaisha, Osaka (JP)

(72) Inventor: Kenichi Nagata, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 15/049,502

(22) Filed: Feb. 22, 2016

(65) Prior Publication Data

US 2016/0291521 A1 Oct. 6, 2016

(30) Foreign Application Priority Data

Apr. 3, 2015 (JP) ..... 2015-076614

(51) Int. Cl.
*G03G 15/08* (2006.01)
*G03G 21/18* (2006.01)

(52) U.S. Cl.
CPC ..... *G03G 15/0863* (2013.01); *G03G 21/1878* (2013.01)

(58) Field of Classification Search
CPC ..... G03G 21/1885
See application file for complete search history.

(56) References Cited

U.S. PATENT DOCUMENTS

2008/0226341 A1* 9/2008 Mase ..... G03G 21/1889 399/119
2014/0286670 A1* 9/2014 Takahashi ..... G03G 21/1652 399/83

FOREIGN PATENT DOCUMENTS

JP 2010-020219 A 1/2010

* cited by examiner

*Primary Examiner* — Clayton E Laballe
*Assistant Examiner* — Victor Verbitsky
(74) *Attorney, Agent, or Firm* — Renner, Otto, Boisselle & Sklar, LLP

(57) ABSTRACT

A cartridge capable of preventing careless damage or the like of a memory unit and an image forming apparatus including the cartridge are provided. A toner cartridge (22*a* to 22*d*) which stores toner used for image formation and which is detachably attached to an attachment portion (51) of an image forming station (Pa to Pd) includes: a cartridge body (27); and a memory unit (60) which is rotatably attached to the cartridge body (27), wherein before the toner cartridge is attached to the attachment portion (51) of the image forming station (Pa to Pd), an electrode terminal portion (83) of the memory unit (60) is protected from the outside by a distal end in an attachment direction C of the cartridge body (27), when the toner cartridge is attached to the attachment portion (51) of the image forming station (Pa to Pd), the memory unit (60) rotates approximately 90 degrees whereby an electrode terminal (83*a* to 83*d*) of the electrode terminal portion (83) is electrically connected to an electrode terminal (53*a* to 53*d*) of the connecting portion (53) of the attachment portion (51).

12 Claims, 11 Drawing Sheets

(a)

(b)

(c)

CARTRIDGE AND IMAGE FORMING APPARATUS

BACKGROUND OF THE INVENTION

The present invention relates to a cartridge and an image forming apparatus which uses the same, and more particularly, to a cartridge having a memory unit capable of storing predetermined information and an image forming apparatus which uses the same.

Examples of image forming apparatuses which use an electrophotographic system or an electrostatic recording system include a copying machine, a printer, a facsimile machine, and a multifunctional peripheral which integrates these apparatuses. In these image forming apparatuses, an electrostatic latent image formed on a photosensitive drum is developed by a toner supplied from a developing device, the developed toner image is transferred from the photosensitive drum to a recording sheet, and the transferred toner image is heated and fused, whereby the toner image is fixed to a recording sheet.

In such an image forming apparatus, since the toner is gradually consumed as image formation is repeated, it is necessary to compensate for the consumed toner appropriately. For example, a hopper is provided on the developing device and a toner cartridge is detachably arranged on the hopper so that toner discharged from the toner cartridge is supplied to the developing device via the hopper. A residual toner amount in the toner cartridge is detected or the number of pixels is counted to calculate a toner consumption amount. When the residual toner amount is depleted, a prompt is issued to a user to replace the toner cartridge to prevent toner shortage.

As described above, the toner cartridge is a consumable supply, and a used toner cartridge after replacement is collected by a supplier, recycled, and sent to a user again as a recycled toner cartridge.

However, since the toner cartridges are products which are naturally circulated in a market as consumable supplies, false products which appear to have compatibility with genuine products may be available to consumers unfortunately. However, with improvement in image quality in recent image forming apparatuses, toner has been also required to have high performance. Thus, if non-genuine toner cartridges are used, desired image quality may not be obtained and the apparatus may be contaminated and may cause malfunction. Further, a toner cartridge cannot be recycled unlimitedly, and the number of recycles is limited by the mechanical lifespan of the toner cartridge body.

As described above, the circumstances surrounding a toner cartridge are becoming complicated. In recent years, there has been proposed a toner cartridge which includes a memory unit including a substrate member on which an IC chip that stores specific information as electronic information and can rewrite the specific information is mounted and which has electrode terminal portions, a housing that holds the substrate member, and a cover member that detachably integrates the substrate member and the housing, and in which the specific information is held in the memory unit.

For example, a toner cartridge in which a memory unit is provided at a distal end in an attachment direction in a state of protruding in the attachment direction and an electrode terminal on an image forming apparatus is electrically connected to an electrode terminal portion of the memory unit when the toner cartridge is slid in the attachment direction is known (for example, see Patent Document 1).

[Patent Document 1] Japanese Unexamined Patent Application, Publication No. 2010-20219

SUMMARY OF THE INVENTION

However, the toner cartridge disclosed in Patent Document 1 has a problem that, since the electrode terminal portion of the memory unit protrudes in the attachment direction, the memory unit is likely to be broken by making contact with a frame or the like near an attachment portion before the toner cartridge enters into the attachment portion. Another problem is that, since the electrode terminal portion of the memory unit is exposed, when an operator touches the electrode terminal portion with his/her hands erroneously, an IC chip in a substrate of the memory unit may be destroyed by static electricity.

Therefore, an object of the present invention is to provide a cartridge capable of preventing damage or destruction of a memory unit or a portion thereof and an image forming apparatus including the cartridge.

A cartridge according to the present invention is a cartridge which stores an image forming material used for image formation and which is detachably attached to an image forming apparatus, including: a cartridge body; and a memory unit which is rotatably attached to an attachment distal end of the cartridge body, wherein before the cartridge starts being inserted into an attachment portion of the image forming apparatus, at least an electrode terminal portion of the memory unit is in a state of being protected from the outside by the attachment distal end of the cartridge body, after the cartridge is inserted into the attachment portion of the image forming apparatus, the memory unit rotates by a predetermined angle with respect to the cartridge body whereby the electrode terminal portion is exposed, and when the cartridge advances further into the attachment portion in a state where the electrode terminal portion is exposed, a first electrode terminal provided in the electrode terminal portion is electrically connected to at least a second electrode terminal provided in the attachment portion.

An image forming apparatus according to the present invention includes: the cartridge described above; the attachment portion which has the second electrode terminal electrically connected at least to the first electrode terminal provided in the electrode terminal portion when the cartridge is inserted into the attachment portion in a state in which the memory unit is rotated by the predetermined angle with respect to the cartridge body and which is configured so that the cartridge is detachably attached to the attachment portion; and an image forming unit for forming an image.

According to the present invention, when the cartridge is inserted into the attachment portion in a state in which the electrode terminal portion is exposed, the first electrode terminal provided in the electrode terminal portion is electrically connected to at least the second electrode terminal provided in the attachment portion, whereby the cartridge can perform its function. Before the cartridge starts being inserted into the attachment portion of the image forming apparatus, at least the electrode terminal portion of the memory unit is protected from the outside by the attachment distal end of the cartridge body. Thus, it is possible to prevent damage or destruction of a memory unit or a portion thereof.

DESCRIPTION OF THE PREFERRED EMBODIMENTS

Figure 1:
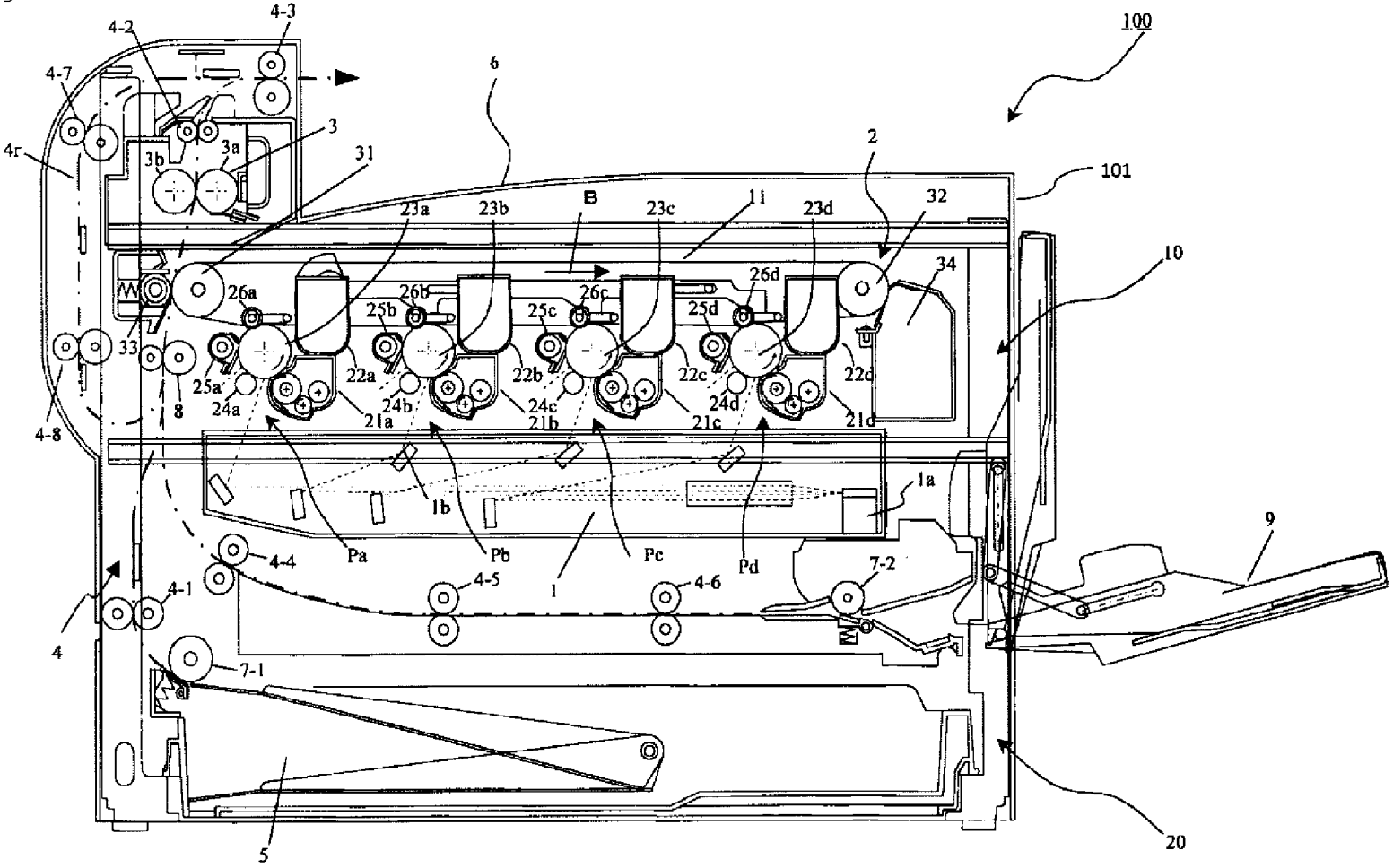
FIG. 1 is a cross-sectional view schematically illustrating an entire configuration of an image forming apparatus according to a first embodiment of the present invention.

Hereinafter, embodiments of the present invention will be described in detail with reference to the drawings.

A memory unit according to an embodiment of the present invention is a memory unit which is attached to a cartridge body and is electrically connected to an image forming apparatus when the cartridge body is attached to the image forming apparatus. The memory unit includes a substrate member on which an IC chip that stores related information related to the cartridge body is mounted and which has an electrode terminal portion that electrically connects the IC chip and the image forming apparatus and a housing on which the substrate member is mounted and which is attached to the cartridge body so as to be rotatable by a predetermined angle.

A toner cartridge according to an embodiment of the present invention is not particularly limited, but means an element which stores an image forming material used for image formation in an image forming apparatus and which is configured to be detachably attached to the image forming apparatus.

The image forming apparatus to which the toner cartridge according to the embodiment of the present invention is attached is not particularly limited, but means a general image forming apparatus such as a copying machine, a printer, a facsimile machine, or a multifunctional peripheral thereof which forms an image on a recording medium according to an electrophotographic system or an electrostatic recording system which uses an image bearing member and toner.

The housing means a casing of the memory unit attached to the cartridge body so as to be rotatable by a predetermined angle and the structure and the material thereof are not particularly limited. The substrate member means a substrate on which the IC chip that stores related information related to the cartridge body is mounted and which has an electrode terminal portion electrically connected to an image forming apparatus when the cartridge body is attached to the image forming apparatus. Various electronic circuits and electronic components in addition to the IC chip may be formed on the substrate.

The related information related to the cartridge body is not particularly limited, but means both or one of general information common to toner cartridges of the same type and information specific to individual toner cartridges. In the present embodiment, the related information is stored in the IC chip as rewritable electronic information or non-rewritable electronic information. The related information includes information that can be roughly classified into the three types of information, unique information, history information, and recycle information, for example.

Here, examples of the unique information include the capacity of an individual toner cartridge, the color of toner stored therein, a lot number, a production date, and a manufacturer. Some or all of these items of information are stored in the IC chip as non-rewritable electronic information. Examples of the history information include a residual toner amount of an individual toner cartridge, the start date of use, and an actual use period. Examples of the recycle information include the number of recycles of an individual toner cartridge, a recycle date, and a supplier. The history information and the recycle information are generally stored in the IC chip as rewritable electronic information. The related information including these items of information is recorded mainly for the purpose of giving a warning against the use of non-genuine toner cartridges, predicting the time to replace a toner cartridge, preventing a recycle over an upper limit number of recycles, and performing a tracking investigation when defective products are found.

In the memory unit of the toner cartridge according to the present embodiment, the housing may have a mounting portion that mounts a substrate member in alignment, and the mounting portion may have a rib of which the position is defined at an edge of the substrate member and which has rigidity. With such a configuration, since the mounting portion has a rib that makes contact with the edge of the substrate member, it is easy to perform alignment when the substrate member is mounted on the mounting portion of the housing.

In the memory unit of the toner cartridge according to the present embodiment, the electrode terminal portion may include a plurality of long and narrow electrode terminals mounted on the substrate member, and the plurality of electrode terminals may be arranged at different positions in a direction vertical to an insertion direction so that the longitudinal directions thereof are arranged in parallel on the substrate member in a connection direction in which the electrode terminals are connected to the image forming apparatus. According to such a configuration, since the plurality of electrode terminals are arranged on one flat surface of the substrate member, the configuration of the substrate member is simplified as compared to a case in which the electrode terminals are arranged on a plurality of surfaces, and the substrate member is easily mounted on the housing. Moreover, since the plurality of electrode terminals are arranged on the substrate member so that the longitudinal directions thereof are arranged approximately in parallel in the connection direction in which the electrode terminals are connected to the image forming apparatus, the electrode terminals can be smoothly connected to the image forming apparatus.

In another aspect, this embodiment provides a toner cartridge having the memory unit according to this embodiment. According to the toner cartridge of this embodiment provides the same effects as the memory unit according to this embodiment.

According to still another aspect, this embodiment provides an image forming apparatus to which the toner cartridge of this embodiment is detachably attached, including: an image forming unit that forms an image corresponding to image information; a sheet conveying unit that conveys a sheet to the image forming unit; and a control unit that controls the image forming unit and the sheet conveying unit, wherein the image forming unit is electrically connected to the memory unit of the toner cartridge when the toner cartridge is attached, and the control unit reads the related information of the toner cartridge from the memory unit and writes information to be updated or added to the memory unit.

Hereinafter, the image forming apparatus including the toner cartridge having the memory unit according to the respective embodiments of the present invention will be described with reference to the drawings. In the respective embodiments, an image forming apparatus including a toner cartridge in which toner as an image forming material is stored will be described.

First Embodiment

Figure 2:
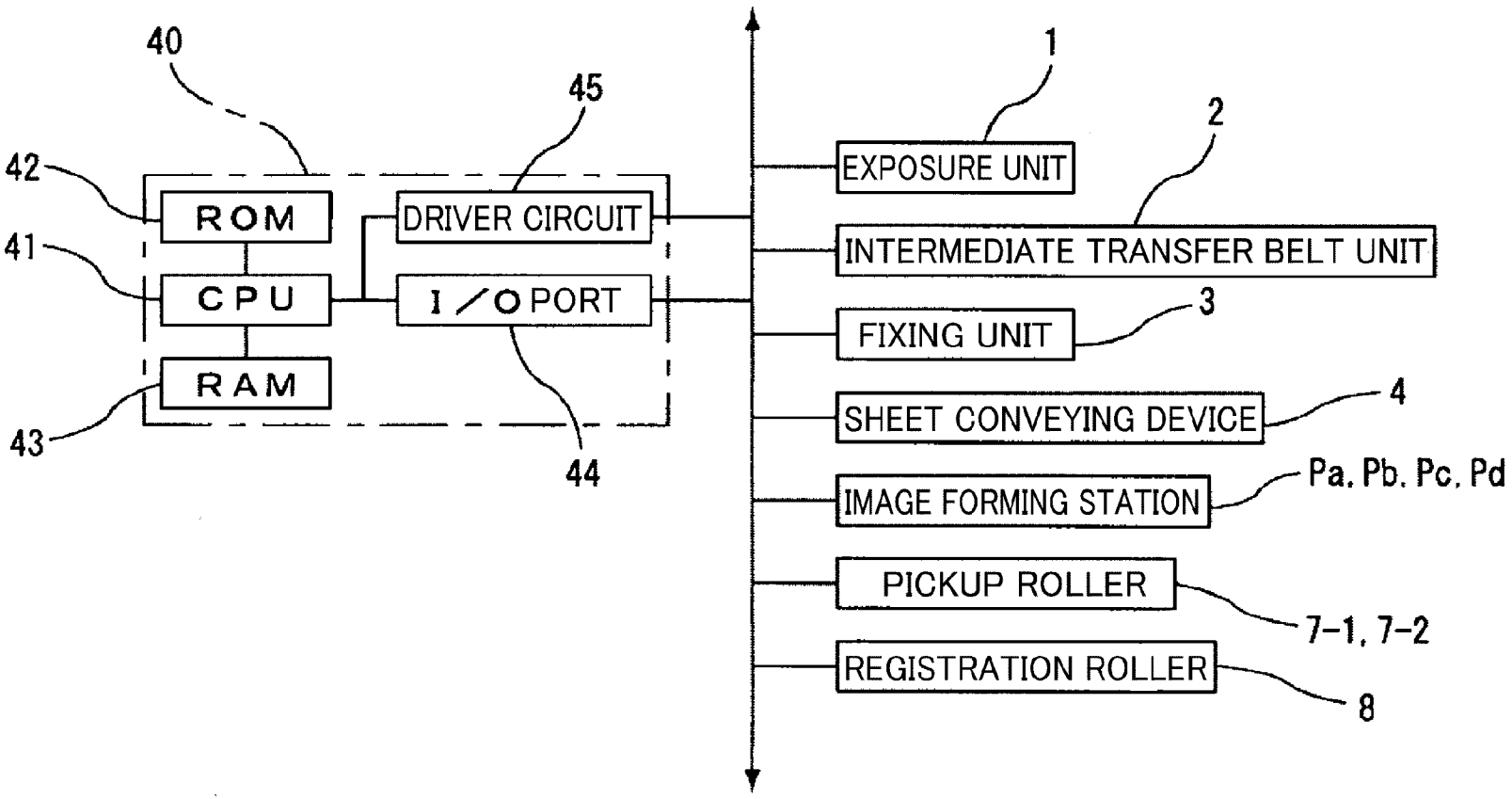
FIG. 2 is a block diagram illustrating a configuration of a control unit that controls the image forming apparatus illustrated in FIG. 1.

First, an entire configuration and an operation of an image forming apparatus 100 according to a first embodiment will be described with reference to FIGS. 1 and 2. FIG. 1 is a cross-sectional view schematically illustrating an entire configuration of an image forming apparatus 100 according to the first embodiment of the present invention. FIG. 2 is a block diagram illustrating a configuration of a control unit that controls the image forming apparatus 100 illustrated in FIG. 1.

As illustrated in FIG. 1, the image forming apparatus 100 is a color laser printer capable of recording a color image on a recording sheet. The image forming apparatus 100 includes an image forming unit 10 that forms an image corresponding to image information, a sheet conveying unit 20 that conveys a sheet to the image forming unit, and a control unit 40 (see FIG. 2) that controls the image forming unit 10 and the sheet conveying unit 20.

The image forming unit 10 includes an exposure unit 1, image forming stations Pa, Pb, Pc, and Pd, an intermediate transfer belt unit 2, a fixing unit 3, and the like. The sheet conveying unit 20 includes a sheet conveying device 4, a sheet feeding tray 5, a sheet discharge tray 6, and the like.

In the image forming apparatus 100, the recording sheet is stacked in a sheet feeding tray 5 and is taken out from the sheet feeding tray 5 one by one by a pickup roller 7-1 and conveyed to a registration roller 8 by a conveying roller 4-1. Alternatively, the recording sheet is placed on a manual feeding tray 9 and is taken out by a pickup roller 7-2 and conveyed to the registration roller 8 by conveying rollers 4-6 to 4-4.

The registration roller 8 stops a recording sheet temporarily to align a leading end of the recording sheet and conveys the recording sheet to a secondary transfer roller 33 at the time when the leading end of the recording sheet overlaps a leading end of a toner image formed on an intermediate transfer belt 11 of the intermediate transfer belt unit 2.

The image forming stations Pa to Pd form toner images of black (K), cyan (C), magenta (M), and yellow (Y), respectively, and the toner images of each color are transferred to the intermediate transfer belt 11 of the intermediate transfer belt unit 2. The image forming stations Pa to Pd include developing cartridges 21*a*, 21*b*, 21*c*, and 21*d*, toner cartridges 22*a*, 22*b*, 22*c*, and 22*d*, photosensitive drums 23*a*, 23*b*, 23*c*, and 23*d*, charging units 24*a*, 24*b*, 24*c*, and 24*d*, cleaner units 25*a*, 25*b*, 25*c*, and 25*d*, and the like, respectively.

The photosensitive drums 23*a* to 23*d* are pressed against primary transfer rollers 26*a*, 26*b*, 26*c*, and 26*d*, respectively, with the intermediate transfer belt 11 interposed and are rotated together with the intermediate transfer belt 11 at the same peripheral speed as the intermediate transfer belt 11 that rotates and moves in a moving direction B. The primary transfer rollers 26*a* to 26*d* also rotate following the intermediate transfer belt 11 at the same peripheral speed as the intermediate transfer belt 11 that rotates and moves in the moving direction B. The charging units 24*a* to 24*d* are rollers or brushes that make contact with the photosensitive drums 23*a* to 23*d*, respectively, or are chargers, and the charging units uniformly charge the surfaces of the photosensitive drums 23*a* to 23*d*.

The exposure unit 1 has a laser light source 1*a* that emits laser beams to the respective photosensitive drums 23*a* to 23*d*, a plurality of mirrors 1*b* that guides the emitted laser beams to the respective photosensitive drums 23*a* to 23*d*, and the like. The exposure unit 1 applies the laser beams to the surfaces of the respective photosensitive drums 23*a* to 23*d* while modulating each laser beam according to image data to form electrostatic latent images on the surfaces of the respective photosensitive drums 23*a* to 23*d*. Here, a writing head in which light-emitting elements such as EL and LED are arranged in an array form may be used as the exposure unit 1.

The toner cartridges 22*a* to 22*d* store toners of black, cyan, magenta, and yellow, respectively. The toner cartridges 22*a* to 22*d* supply the toners to the developing cartridges 21*a* to 21*d*, respectively. The developing cartridges 21*a* to 21*d* attach the toners of each color to the electrostatic latent images on the surfaces of the photosensitive drums 23*a* to 23*d* to form toner images of each color on the surfaces of the photosensitive drums 23*a* to 23*d*. The toner images of each color are transferred from the photosensitive drums 23*a* to 23*d* to the intermediate transfer belt 11 in a superimposed manner.

The intermediate transfer belt 11 is formed, for example, of a synthetic resin film having a thickness of approximately 100 μm to 150 μm. The secondary transfer roller 33 is supported so as to be movable in a right-and-left direction of FIG. 1 and forms a nip area with the intermediate transfer belt 11 sandwiched between the secondary transfer roller 33 and a drive support roller 31 when moved to the right side.

The drive support roller 31 is rotated while playing the role of a backup roller that presses the intermediate transfer belt 11 against the secondary transfer roller 33. The drive support roller 31 causes the intermediate transfer belt 11 to rotate and move in the moving direction B so that each nip area between the primary transfer rollers 26*a* to 26*d* and the photosensitive drums 23*a* to 23*d* moves to a downstream side sequentially. As a result, each nip area is stably maintained. In order to form each nip area between the primary transfer rollers 26*a* to 26*d* and the photosensitive drums 23*a* to 23*d* more stably, it is preferable that one of the primary transfer rollers 26*a* to 26*d* and the photosensitive drums 23*a* to 23*d* is formed of a hard material and the other is formed of an elastic material.

The primary transfer rollers 26*a* to 26*d* are produced by coating an outer circumference of a metallic shaft having a diameter of 8 mm to 10 mm with a conductive elastomer (EPDM, foamed urethane, and the like), for example. A bias voltage of a polarity opposite to the charge polarity of the toner is applied to the primary transfer rollers 26*a* to 26*d* in a state in which the intermediate transfer belt 11 is sandwiched in the nip areas between the primary transfer rollers 26*a* to 26*d* and the photosensitive drums 23*a* to 23*d*. An electric field generated by the application of the bias voltage acts on the toners on the surfaces of the photosensitive drums 23*a* to 23*d* via the intermediate transfer belt 11, and the toners on the surfaces of the photosensitive drums 23*a* to 23*d* are attracted and transferred to the intermediate transfer belt 11. As a result, the toner images of each color are transferred to the intermediate transfer belt 11 in a superimposed manner. Instead of rollers, brushes or the like may be used as the primary transfer rollers 26*a* to 26*d*.

A cleaning unit 34 is, for example, a cleaning blade that makes sliding contact with the surface of the intermediate transfer belt 11 and removes a toner remaining on the surface of the intermediate transfer belt 11 to prevent fogging of an image to be printed next.

A multicolor (color) toner image that has been transferred to the intermediate transfer belt 11 in a superimposed manner in this way is conveyed to the nip area between the drive support roller 31 and the secondary transfer roller 33 with rotation of the intermediate transfer belt 11. In this case, the registration roller 8 conveys a recording sheet to the nip area at the time when a leading end of the multicolor toner image matches a leading end of the recording sheet conveyed to the nip area, and the multicolor toner image is transferred to the recording sheet.

Subsequently, the recording sheet is conveyed to the fixing unit 3 where the recording sheet is sandwiched between a pressure roller 3*a* and a heat roller 3*b*. As a result, the multicolor toner image on the recording sheet is heated and fused and is fixed on the recording sheet as a color image. After that, the recording sheet is discharged to the sheet discharge tray 6 by the sheet conveying device 4 and is placed on the sheet discharge tray 6 in a face-down method where an image forming surface faces downward.

Here, a monochrome image may be formed using the image forming station Pa only, and the monochrome image may be transferred to the intermediate transfer belt 11 of the intermediate transfer belt unit 2. The monochrome image is also transferred from the intermediate transfer belt 11 to a recording sheet and is fixed on the recording sheet similarly to the color image. Printing may be performed not only on a front surface of a recording sheet but also on both surfaces. In this case, after a toner image transferred to a front surface of a recording sheet is fixed by the fixing unit 3, the recording sheet is conveyed toward the sheet discharge tray 6 by the conveying roller 4-3. During this period, the conveying roller 4-3 is stopped and rotated in a reverse direction so that the recording sheet passes through a reversal path 4*r* to reverse the recording sheet. After that, the recording sheet is guided to the registration roller 8 and a toner image is transferred and fixed to the rear surface of the recording sheet in the same manner as forming an image on the front surface. Subsequently, the recording sheet is discharged to the sheet discharge tray 6.

As illustrated in FIG. 2, the control unit 40 is a microcomputer including a CPU 41 that performs an arithmetic process, a ROM 42 that stores a control program performed by the CPU 41, a RAM 43 that provides a work area to the CPU 41, an I/O port 44 that inputs and outputs a control signal to and from various sensors under the control of the CPU 41, a driver circuit 45 that drives various driving units under the control of the CPU 41, and the like. The control unit 40 controls the image forming apparatus 100 including the exposure unit 1 and the image forming stations Pa to Pd in an integrated manner.

Figure 3:
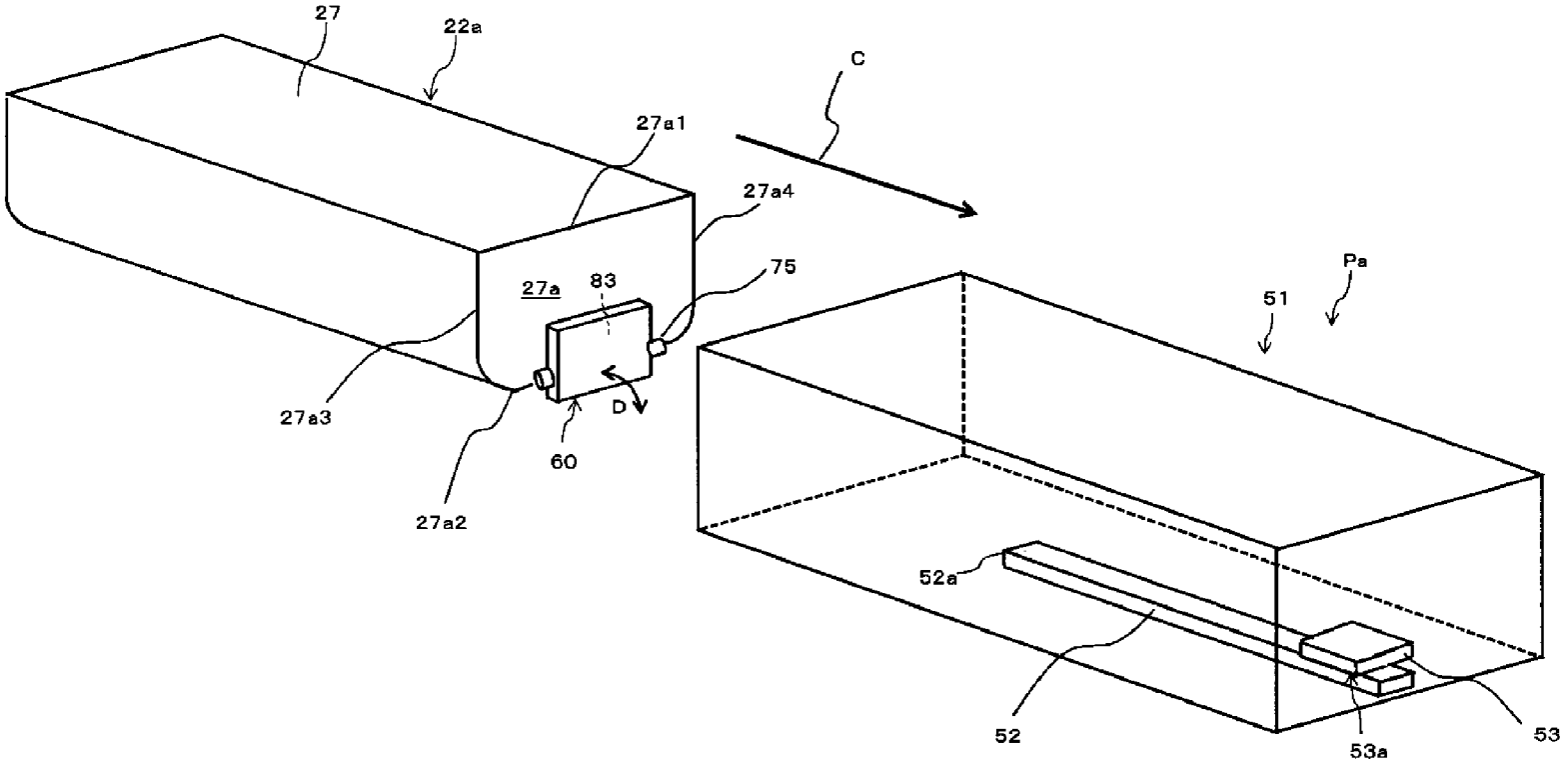
FIG. 3 is a perspective view illustrating a toner cartridge and an attachment portion according to the first embodiment.
Figure 4:
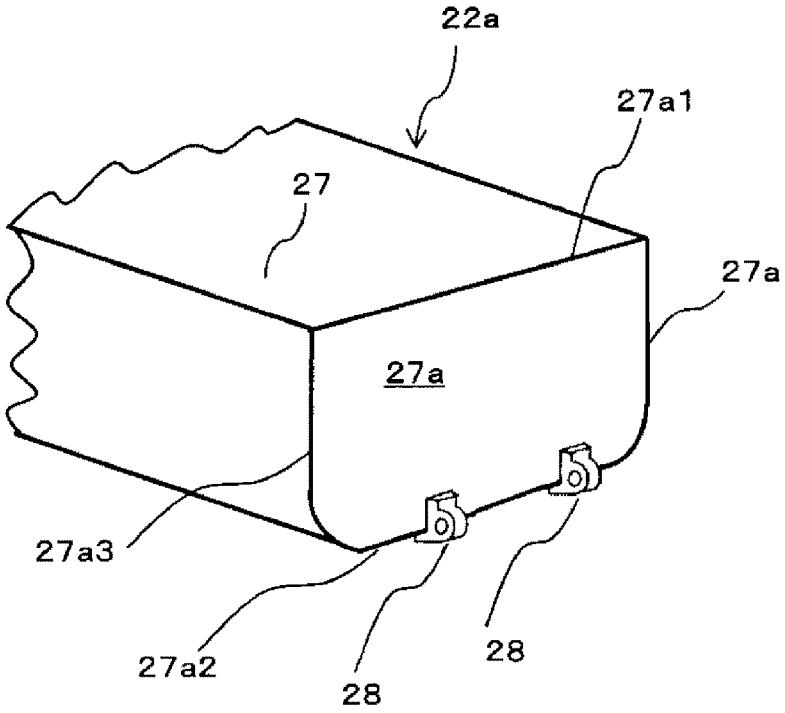
FIG. 4 is a perspective view illustrating a bearing of a cartridge body according to the first embodiment.

Next, the toner cartridges 22*a* to 22*d* will be described with reference to FIG. 3 to FIG. 8. Since the toner cartridges 22*a* to 22*d* have the same configuration, the toner cartridge 22*a* will be described herein and the description of the toner cartridges 22*b* to 22*d* will not be provided. First, an overall configuration of the toner cartridge 22*a* will be described with reference to FIG. 3. FIG. 3 is a diagram schematically illustrating the toner cartridge 22*a* according to the first embodiment.

The toner cartridge 22*a* is configured to be detachably attached to the image forming station Pa. Specifically, the image forming station Pa has an attachment portion 51 illustrated in FIG. 3 and the toner cartridge 22*a* is configured to be detachably attached to the attachment portion 51 of the image forming station Pa.

The toner cartridge 22*a* includes a cartridge body 27 which has an approximately rectangular parallelepiped shape and in which toner is stored and a memory unit 60 attached to a distal end (an attachment distal end) in an attachment direction (the direction indicated by arrow C illustrated in FIG. 3, and hereinafter referred to as an "attachment direction C") of the cartridge body 27 in relation to the attachment portion 51. The memory unit 60 is attached to the cartridge body 27 so as to be pivotable in the direction indicated by arrow D illustrated in FIG. 3. Moreover, the memory unit 60 has an IC chip 81 (see FIG. 5 described later). The IC chip 81 stores related information related to the toner cartridge as electronic information for the purpose of giving a warning against the use of non-genuine toner cartridges, preventing erroneous attachment of a toner cartridge of a wrong color, predicting the time to replace the toner cartridge 22*a*, preventing a recycle over an upper limit number of recycles, and performing a tracking investigation when defective products are found.

The related information includes information that can be roughly classified into the three types of information, unique information, history information, and recycle information, for example. Examples of the unique information include a product number, a capacity, a toner color, a lot number, a production date, and a manufacturer. Examples of the history information include a residual toner amount, the start date of use, an actual use period, a toner end date, and cumulative usage data (for example, a total cumulative number of printed sheets). Examples of the recycle information include the number of recycles, a recycle date, and a supplier.

When the toner cartridge 22*a* is attached to the attachment portion 51 of the image forming station Pa, the memory unit 60 is electrically connected to an electrode terminal 53*a* (see FIG. 8 described later) of a connecting portion 53 provided in the attachment portion 51. A shutter member (not illustrated) is provided in a toner outlet port (not illustrated) of the toner cartridge 22*a*, and the shutter member is open when the toner cartridge 22*a* is attached to the attachment portion 51 so that the toner outlet port communicates with a toner inlet port (not illustrated).

Figure 5:
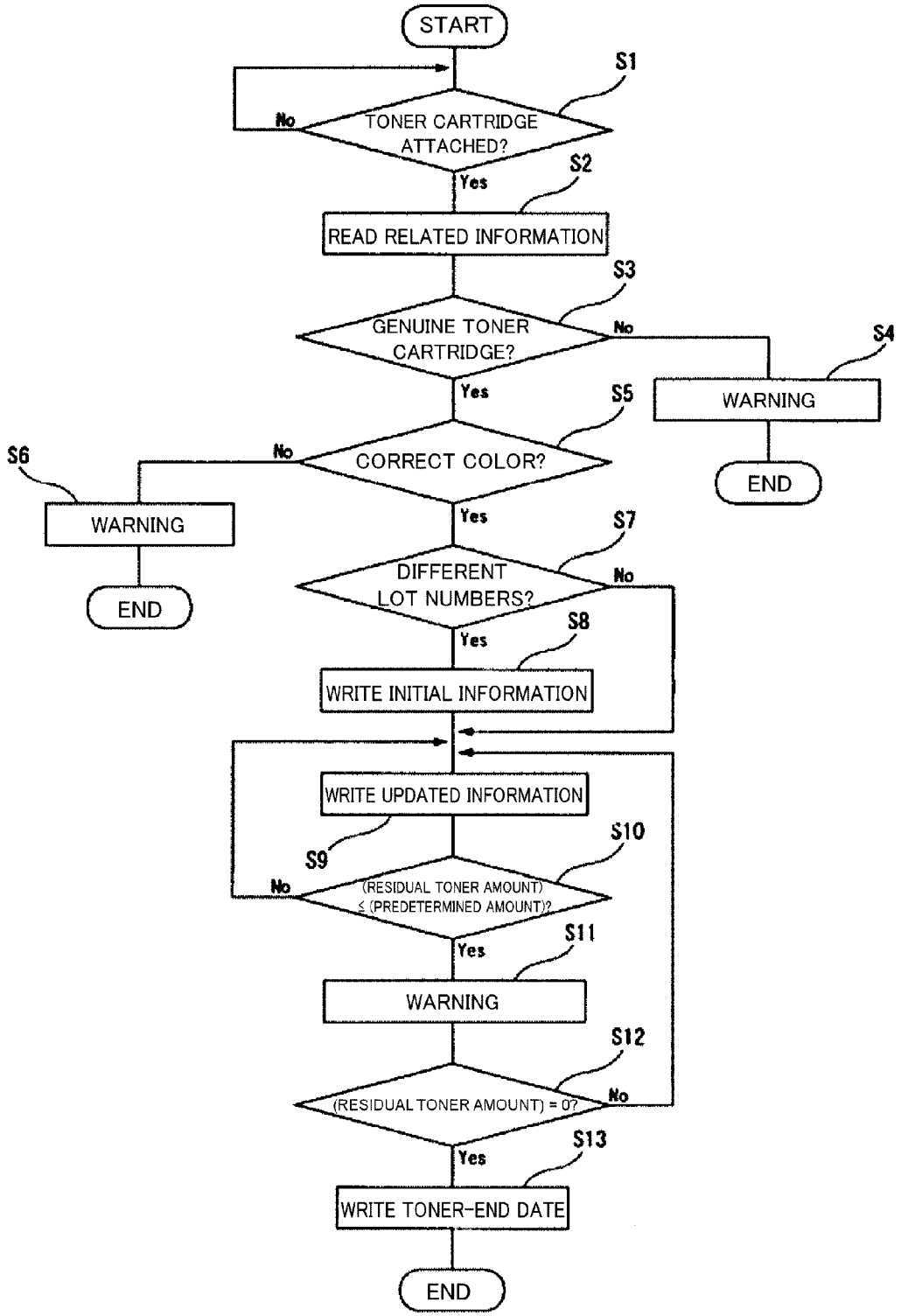
FIG. 5 is a flowchart illustrating a control operation of the control unit when the toner cartridge is attached to the attachment portion.

Next, a control operation of the control unit 40 on the toner cartridge 22*a* when the toner cartridge 22*a* is attached to the attachment portion 51 will be described with reference to FIG. 5. FIG. 5 is a flowchart illustrating a control operation of the control unit 40 when the toner cartridge 22*a* is attached to the attachment portion 51.

As illustrated in FIG. 5, when the toner cartridge 22*a* is attached to the attachment portion 51 (step S1), the related information stored in the IC chip 81 of the memory unit 60 is read via the connecting portion 53 of the attachment portion 51 (step S2) and it is determined whether the attached toner cartridge is a genuine product that is suitable for the model of the image forming apparatus (step S3). When it is determined that the attached toner cartridge is a non-genuine product that is not suitable for the model, a warning prompt is issued to a user to replace with a genuine toner cartridge suitable for the model (step S4).

Instead of step S4 in which a warning is issued, a step of checking a user's intention may be provided so that, if the user wants to use a non-genuine product, the user may be allowed to use the non-genuine product. In this case, since it is highly likely that the IC chip 81 is also not suitable for the model, step S5 and the subsequent steps are skipped and a toner end is detected by a permeability sensor of the developing cartridge 21*a*, for example.

When it is determined in step S3 that the attached toner cartridge is a genuine product suitable for the model, it is determined whether a toner cartridge of a wrong color is erroneously attached (step S5). When it is determined that a toner cartridge of a wrong color is attached, a warning is issued to the user to attach the toner cartridge 22*a* of the correct color (step S6).

When it is determined in step S5 that the toner cartridge 22*a* of the correct color is attached, the lot number of the toner cartridge 22*a* attached presently is compared with the lot number of a toner cartridge attached previously (step S7). When the two lot numbers are different, it is determined that a new toner cartridge 22*a* is attached. Initial information such as the start date of use, the actual use period (that is, zero), and the residual toner amount (that is, full) is written to the IC chip 81 of the memory unit 60 via the connecting portion 53 (step S8).

The information on the actual use period is updated every predetermined period (for example, one hour) when the image forming apparatus 100 is operating, the cumulative usage data is updated whenever a predetermined number of sheet (for example, 100 sheet) are printed, and the information on the residual toner amount is updated when toner is supplied from the toner cartridge 22*a* to the developing cartridge 21*a* (step S9).

When it is determined that the residual toner amount is a predetermined amount or smaller (step S10), it is determined that the replacement of the toner cartridge 22*a* is needed in near future, and a warning is issued to the user to prompt preparation of a new toner cartridge (step S11). When the information on the residual toner amount indicates empty, it is determined that the toner has been depleted (step S12), the information on a toner end date is written to the IC chip 81 (step S13), and a series of process flows ends.

Figure 6:
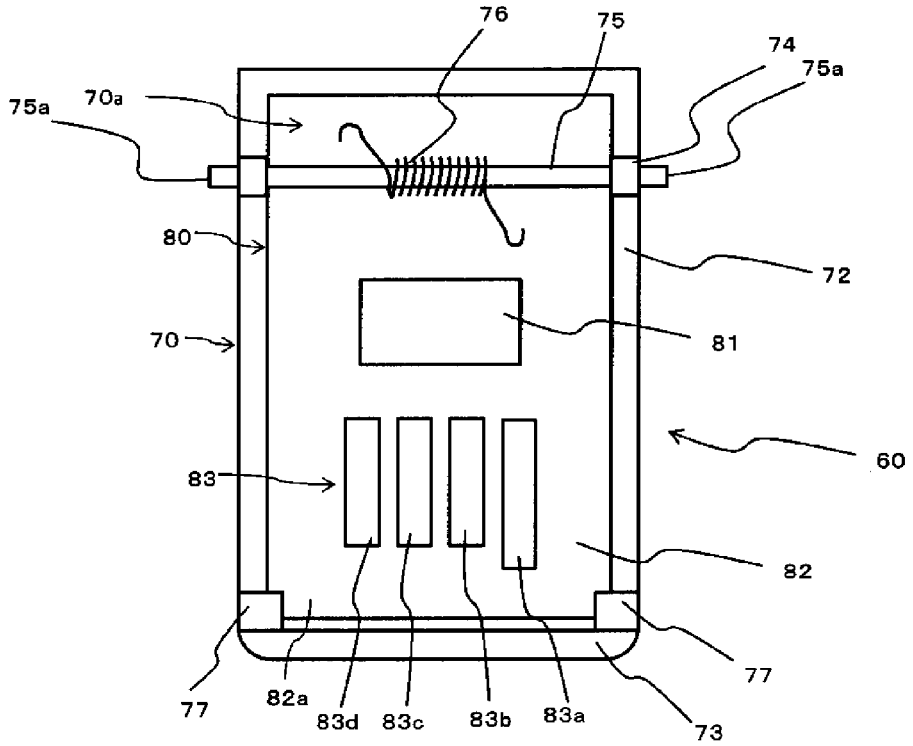
FIG. 6 is a plan view illustrating a memory unit of the toner cartridge according to the first embodiment.
Figure 7:
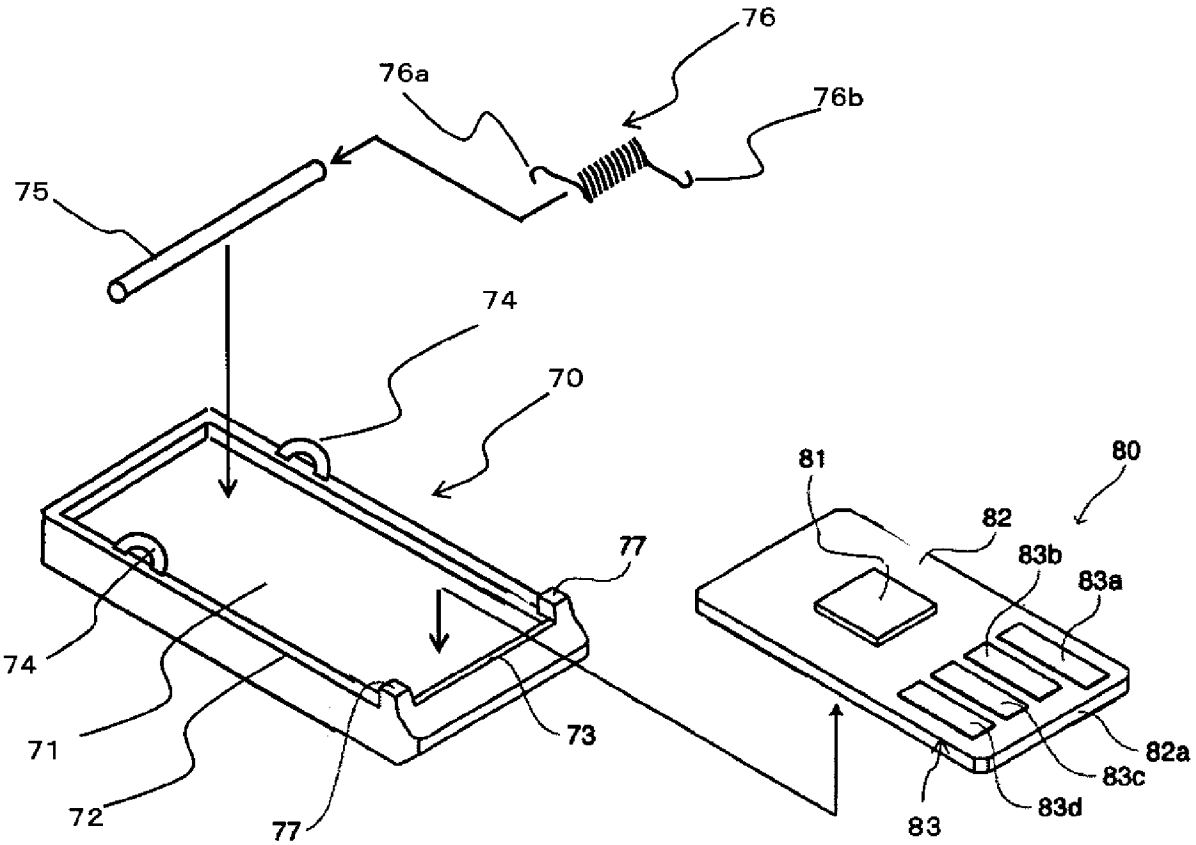
FIG. 7 is an exploded view of the memory unit illustrated in FIG. 5.
Figure 8:
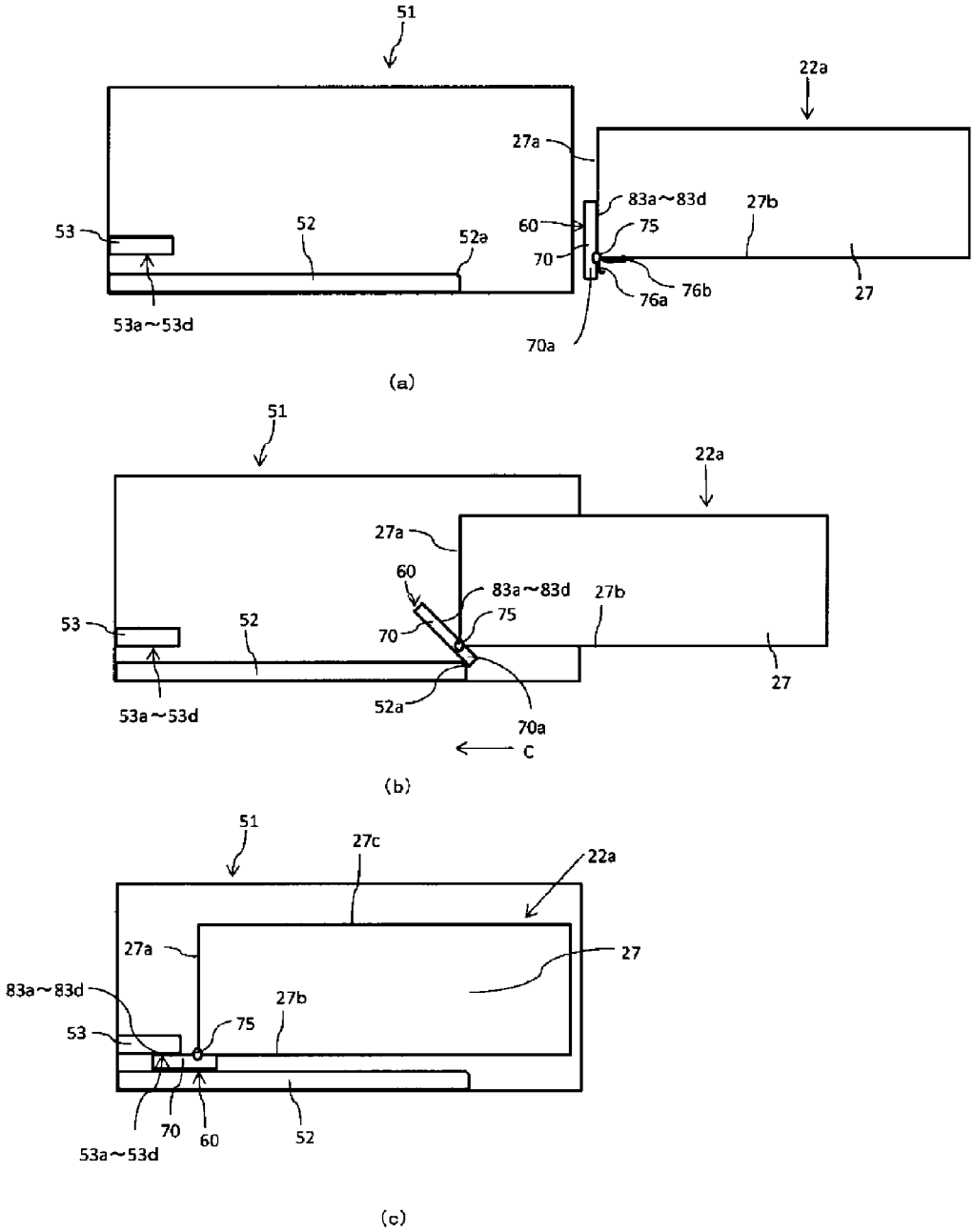
FIG. 8 is a diagram illustrating a state transition when the toner cartridge according to the first embodiment is attached to the attachment portion.

Next, the memory unit 60 will be described with reference to FIG. 6 to FIG. 8. FIG. 6 is a diagram illustrating the memory unit 60 of the toner cartridge 22*a* according to the first embodiment. FIG. 7 is an exploded view of the memory unit 60 illustrated in FIG. 6. FIG. 8 is diagram illustrating a state in which the toner cartridge 22*a* according to the first embodiment is attached to the attachment portion 51.

As illustrated in FIG. 6, the memory unit 60 includes the IC chip 81 that stores the related information related to the toner cartridge 22*a* (see FIG. 3), a substrate member 80 having a substrate 82 on which the IC chip 81 is mounted, and a housing 70 on which the substrate member 80 is mounted. With the housing 70 and the peripheral mechanisms thereof, the memory unit 60 is attached to the housing 70 so as to be rotatable by a predetermined angle.

As illustrated in FIG. 7, the substrate member 80 has a rectangular planar shape, four electrode terminals 83*a*, 83*b*, 83*c*, and 83*d* are formed in the electrode terminal portion 83 which is a portion of the substrate member 80, and the IC chip 81 is mounted near the electrode terminals 83*a* to 83*d*. The electrode terminals 83*a* to 83*d* formed on the substrate member 80 and the IC chip 81 mounted on the substrate member 80 are electrically connected by a circuit (not illustrated) formed on the surface of the substrate 82.

A front edge 82*a* of the substrate member 80 in which the electrode terminals 83*a* to 83*d* are formed is a portion that serves as a distal end of the substrate member 80 when the memory unit 60 of the toner cartridge 22*a* is connected to the connecting portion 53 of the attachment portion 51 of the image forming station Pa. Both longer sides of each of the electrode terminals 83*a* to 83*d* are arranged in parallel in an attachment direction (connection direction) C in which the electrode terminal is attached to the connecting portion 53 and these terminals are arranged at different positions in a direction vertical to the insertion direction. The same electrode terminals 53*a* to 53*d* (see FIG. 8) are also formed on the lower surface of the connecting portion 53. When the memory unit 60 is connected to the connecting portion 53, the electrode terminals 83*a* to 83*d* formed on the substrate member 80 are electrically connected to the electrode terminals 53*a* to 53*d* of the connecting portion 53, respectively.

The housing 70 has a mounting portion 71 that mounts the substrate member 80 in alignment. The mounting portion 71 has a shape corresponding to the substrate member 80 and a rib 72 is formed on a peripheral edge thereof so as to define the area of the mounting portion 71. The rib 72 has a front edge 73 that makes contact with a front edge 82*a* of the substrate member 80 when the substrate member 80 is mounted on the mounting portion 71. The front edge 73 is a portion that serves as a distal end of the memory unit 60 when the memory unit 60 is connected to the connecting portion 53. Two rolling bearings 74 are formed near the other end side in the attachment direction C of the front edge 73 of the rib 72 so that the housing 70 is attached to the cartridge body 27 so as to be rotatable by a predetermined angle. Two pressing pieces 77 as engagement portions are formed on both ends of the front edge 73 of the rib 72 so that the pressing pieces are covered by both ends of the front edge 82*a* of the substrate member 80.

The substrate member 80 is mounted on the mounting portion 71 so that the front edge 82*a* of the substrate member 80 is located under the pressing pieces 77. After that, as illustrated in FIG. 6, a rotation shaft 75 is attached to the rolling bearings 74, and a torsion coil spring (a biasing member) 76 is attached to the rotation shaft 75 whereby the substrate member 80 is aligned on the mounting portion 71.

In this manner, the substrate member 80 is mounted on the mounting portion 71 of the housing 70 and the memory unit 60 is assembled. As illustrated in FIG. 8(*a*), the rotation shaft 75 of the housing 70 is attached to bearings 28 (see FIG. 4) provided on a lower side 27*a*2 (see FIG. 3) of a distal end surface 27*a* of the cartridge body 27 whereby the memory unit 60 is attached to the cartridge body 27. For example, a pair of bearings 28 for receiving both ends 75*a* of the rotation shaft 75 is provided on the lower side 27*a*2 so that both ends 75*a* of the rotation shaft 75 are received by the bearings 28. In this attachment state, as illustrated in FIG. 8, an end 70*a* of the housing 70 protrudes downward further than the lower surface 27*b* of the cartridge.

In this case, a left distal end 76*a* of the torsion coil spring 76 makes contact with the substrate member 80 and a right distal end 76*b* of the torsion coil spring 76 makes contact with the lower surface 27*b* of the cartridge body 27. In this way, a state in which the angle between the right distal end 76*b* and the left distal end 76*a* of the torsion coil spring 76 is approximately the right angle and the memory unit 60 is biased toward the distal end surface 27*a* of the cartridge body 27 about the rotation shaft 75 is created. That is, a state in which the housing 70 makes contact with the front end surface 27*a* of the cartridge body 27 and the IC chip 81 and the electrode terminals 83*a* to 83*d* of the housing 70 are protected by the distal end surface 27*a* of the cartridge body 27 (that is, those portions are not exposed to the outside) is created. Although the end 70*a* protrudes downward further than the lower surface 27*b*, since the protrusion length is shorter than the entire length of the memory unit 60, the probability that a surrounding object strikes on the end 70*a* is low. Even if a surrounding object strikes on the end 70*a*, since the moment of the force received from the surrounding object is small, the possibility that the memory unit 60 is separated from the cartridge body 27 or is damaged decreases.

As illustrated in FIG. 8(*a*), before the cartridge body 27 is attached to the attachment portion 51 of the image forming station Pa, the memory unit 60 attached to the cartridge body 27 is in such a state that the IC chip 81 and the electrode terminals 83*a* to 83*d* of the housing 70 are protected by the distal end surface 27*a* of the cartridge body 27.

When the cartridge body 27 starts being inserted into the attachment portion 51, as illustrated in FIG. 8(*b*), first, a downwardly protruding portion (specifically, the end 70*a* of the housing 70) of the memory unit 60 makes contact with a distal end 52*a* of a step 52 inside the attachment portion 51 near the inlet of the attachment portion 51. By the moment of force that the end 70*a* receives from the distal end 52*a* during the contact, the memory unit 60 rotates about the rotation shaft 75 (in FIG. 8(*b*), rotates leftward) while resisting the biasing force of the torsion coil spring 76. The memory unit 60 is inserted between the step 52 and the cartridge body 27 whereby the memory unit 60 is rotated by a predetermined angle until the memory unit 60 is approximately parallel to the step 52. In the present embodiment, the memory unit 60 rotates by approximately 90 degrees.

When the housing 70 rotates by approximately 90 degrees, the protected electrode terminals 83*a* to 83*d* are exposed to enter a state in which the electrode terminals 83*a* to 83*d* can be connected to the electrode terminals 53*a* to 53*d* provided in the connecting portion 53. When the cartridge body 27 advances further in this state, the memory unit 60 moves along the step 52 and as illustrated in FIG. 8(*c*), a state in which the memory unit 60 is inserted between the connecting portion 53 and the step 52 is created. Moreover, the electrode terminals 53*a* to 53*d* provided in the connecting portion 53 are electrically connected to the electrode terminals 83*a* to 83*d* provided in the memory unit 60. Since the position of the cartridge body 27 is restricted by the weight of the cartridge body 27 or the attachment portion 51 (including a non-illustrated member (for example, a member that restricts the upper surface 27*c* from above)), the cartridge body 27 can be moved until the state of FIG. 8(*c*) is created while maintaining a predetermined angle until the memory unit 60 is approximately parallel to the step 52.

The rib 72 of the mounting portion 71 is shaped such that the thickness of the front edge 73 that makes the first contact with the connecting portion 53 gradually decreases as it advances in the attachment direction C and both ends of the front edge 73 are rounded. Thus, the memory unit 60 is smoothly connected to the connecting portion 53 without being caught at the connecting portion 53. After the cartridge 22*a* is detached from the attachment portion 51, the memory unit 60 is biased toward the distal end surface 27*a* of the cartridge body 27 by the restoring force of the torsion coil spring 76, whereby the memory unit 60 makes close contact with the cartridge body 27. After that, the cartridge 22*a* is removed from the image forming station Pa in a state in which the electrode terminals 83*a* to 83*d* of the memory unit 60 are protected.

As described above, in the present embodiment, before the cartridge body 27 is attached to the attachment portion 51 of the image forming station Pa, the memory unit 60 is biased toward the distal end surface 27*a* of the cartridge body 27 by the biasing force of the torsion coil spring 76, and the memory unit 60 is in contact with the distal end surface 27*a* of the cartridge body 27. That is, the electrode terminals 83*a* to 83*d* of the memory unit 60 are protected by the distal end surface 27*a*. Thus, it is possible to prevent the destruction of the memory unit 60 by making contact with a portion near the inlet or the like of the attachment portion 51 during attachment to the image forming station Pa, for example. Moreover, it is possible to prevent an operator from touching the electrode terminals 83*a* to 83*d* of the memory unit 60 before attachment to electrostatically destroy the IC chip 81.

When the cartridge body 27 is attached to the attachment portion 51 of the image forming station Pa, the cartridge body 27 is pressed by the distal end 52*a* of the step 52 whereby the memory unit 60 is rotated by approximately 90 degrees while resisting the biasing force of the torsion coil spring 76. In this way, the electrode terminals 83*a* to 83*d* of the memory unit 60 can be electrically connected to the electrode terminals 53*a* to 53*d* of the connecting portion 53 of the attachment portion 51.

Second Embodiment

Figure 9:
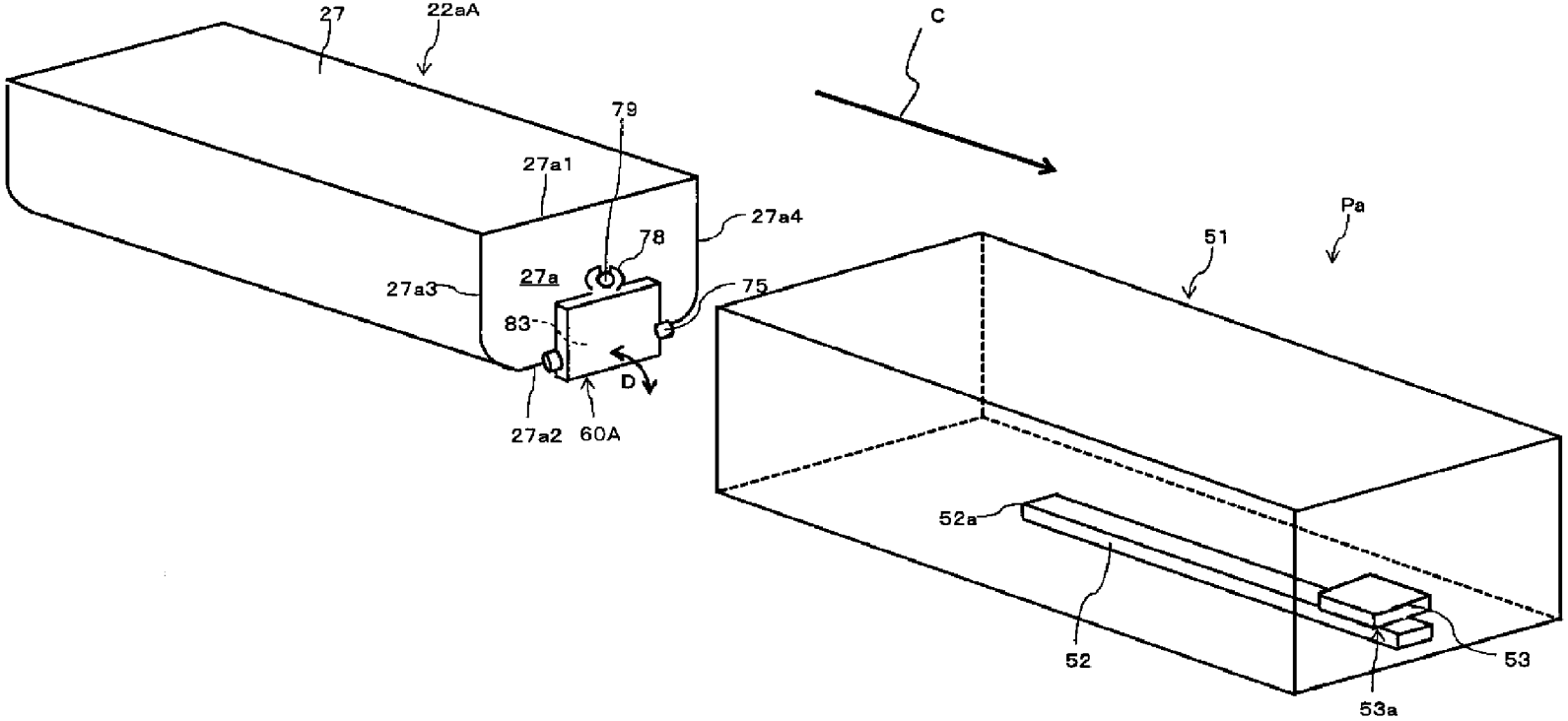
FIG. 9 is a perspective view illustrating a toner cartridge and an attachment portion according to a second embodiment.
Figure 10:
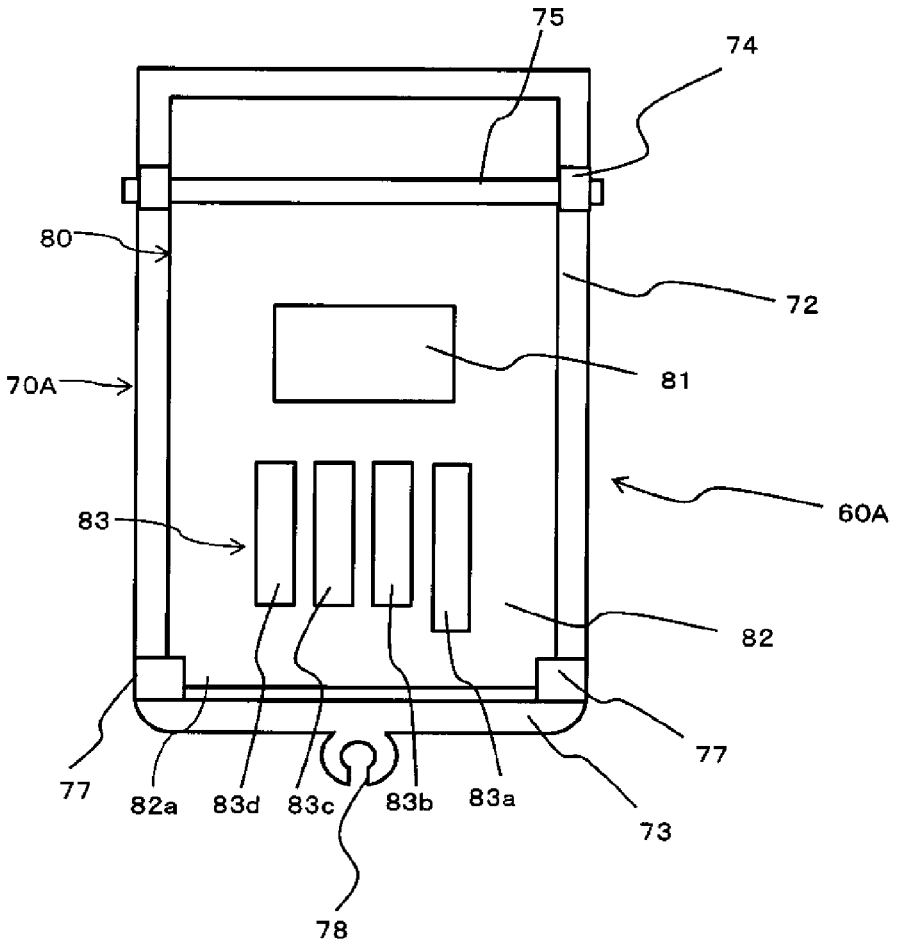
FIG. 10 is a plan view illustrating a memory unit of the toner cartridge according to the second embodiment.
Figure 11:
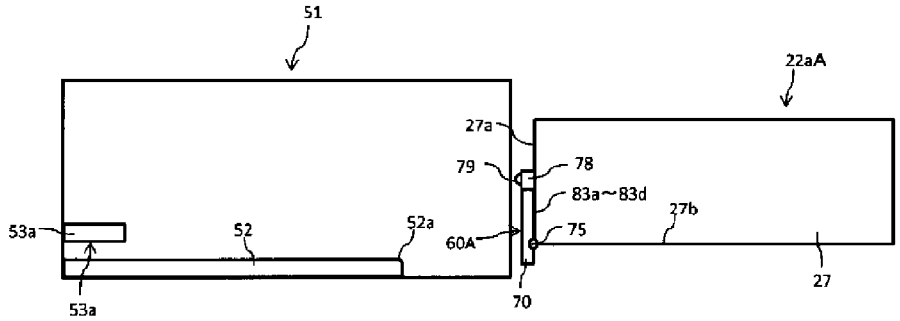
FIG. 11 is a diagram illustrating a state transition when the toner cartridge according to the second embodiment is attached to the attachment portion.
Figure 11:
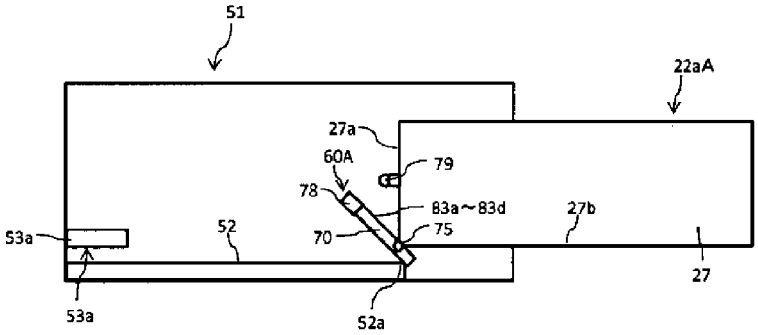
Figure 11:
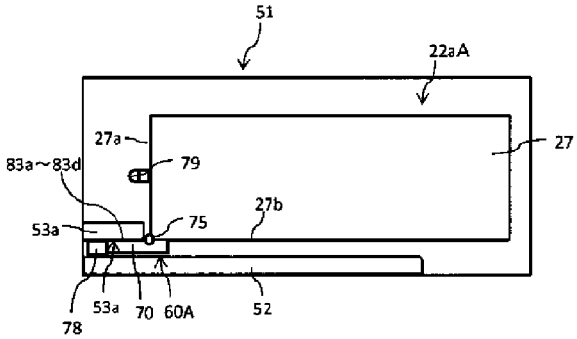

Next, a second embodiment of the present invention will be described with reference to FIG. 9 to FIG. 11. A memory unit of the second embodiment of the present invention has a different configuration from that of the first embodiment. Thus, in this example, the memory unit will be described mainly, and the other configurations will be denoted by the same reference numerals as those of the first embodiment and the description thereof will not be provided. FIG. 9 is a diagram schematically illustrating a toner cartridge 22*a*A according to the second embodiment. FIG. 10 is a diagram illustrating a memory unit 60A of the toner cartridge 22*a*A according to the second embodiment. FIG. 11 is diagram illustrating a state in which the toner cartridge 22*a*A according to the second embodiment is attached to the attachment portion 51.

As illustrated in FIG. 9, the toner cartridge 22*a*A is configured to be detachably attached to the attachment portion 51 of the image forming station Pa. The toner cartridge 22*a*A includes a cartridge body 27 which has an approximately rectangular parallelepiped shape and in which toner is stored and a memory unit 60A attached to a distal end in an attachment direction (the direction indicated by arrow C illustrated in FIG. 9) C of the cartridge body 27 in relation to the attachment portion 51. The memory unit 60A is attached to the cartridge body 27 so as to be pivotable in the direction indicated by arrow D illustrated in FIG. 9.

As illustrated in FIG. 10, the memory unit 60A includes an IC chip 81 that stores related information related to the toner cartridge 22*a*A, a substrate member 80 having a substrate 82 on which the IC chip 81 is mounted, and a housing 70A on which the substrate member 80 is mounted and which is attached to the cartridge body 27 so as to be rotatable by a predetermined angle.

The housing 70A has a mounting portion 71 that mounts the substrate member 80 in alignment. The mounting portion 71 has a shape corresponding to the substrate member 80 and a rib 72 is formed on a peripheral edge thereof so as to define the area of the mounting portion 71. The rib 72 has a front edge 73 that makes contact with a front edge 82*a* of the substrate member 80 when the substrate member 80 is mounted on the mounting portion 71. An engaging concave portion (a concave portion) 78 that engages with an engaging convex portion (a convex portion) 79 formed on a distal end surface 27*a* of the cartridge body 27 is formed approximately at the center in a width direction, of the distal end in the attachment direction C of the front edge 73. When the engaging concave portion 78 engages with the engaging convex portion 79, a state in which the housing 70A makes contact with the distal end surface 27*a* of the cartridge body 27 and the IC chip 81 and the electrode terminals 83*a* to 83*d* of the housing 70A are protected by the distal end surface 27*a* of the cartridge body 27 is created.

Two rolling bearings 74 for attaching the housing 70A so as to be rotatable by a predetermined angle are provided near the other end of the front edge 73 of the rib 72. Two pressing pieces 77 as engagement portions are formed on both ends of the front edge 73 of the rib 72 so that the pressing pieces are covered by both ends of the front edge 82*a* of the substrate member 80.

As illustrated in FIG. 11(*a*), before the cartridge body 27 is attached to the attachment portion 51 of the image forming station Pa, the memory unit 60A attached to the cartridge body 27 is in such a state that the IC chip 81 and the electrode terminals 83*a* to 83*d* of the housing 70A are protected by the distal end surface 27*a* of the cartridge body 27.

When the cartridge body 27 enters into the attachment portion 51, the lower portion of the memory unit 60A makes contact with the distal end 52*a* of the step 52 inside the attachment portion 51 as illustrated in FIG. 11(*b*). When the lower portion of the memory unit 60A makes contact with the distal end 52*a* of the step 52, the lower portion of the memory unit 60A is pressed by the distal end 52*a* and the engaging concave portion 78 of the housing 70A disengages from the engaging convex portion 19 of the cartridge body 27. When the two portions are disengaged, the housing 70 rotates about the rotation shaft 75. The housing 70 rotates by a predetermined angle until the housing 70 is approximately parallel to the step 52. In the present embodiment, the housing 70 rotates by approximately 90 degrees.

When the housing 70A rotates by approximately 90 degrees, the protected electrode terminals 83*a* to 83*d* are exposed to enter a state in which the electrode terminals 83*a* to 83*d* can be connected to the electrode terminals 53*a* to 53*d* provided in the connecting portion 53. When the cartridge body 27 is inserted further in this state, the memory unit 60A moves along the step 52 and as illustrated in FIG. 11(*c*), the electrode terminals 53*a* to 53*d* of the connecting portion 53 are electrically connected to the electrode terminals 83*a* to 83*d* of the memory unit 60A.

As described above, in the present embodiment, before the cartridge body 27 is attached to the attachment portion 51 of the image forming station Pa, the memory unit 60A is in contact with the distal end surface 27*a* of the cartridge body 27 due to the engagement between the engaging concave portion 78 and the engaging convex portion 79. That is, the electrode terminals 83*a* to 83*d* of the memory unit 60 are protected by the distal end surface 27*a*. Thus, it is possible to prevent the destruction of the memory unit 60 by making contact with a portion near the inlet or the like of the attachment portion 51 during attachment to the image forming station Pa, for example. Moreover, it is possible to prevent an operator from touching the electrode terminals 83*a* to 83*d* of the memory unit 60 before attachment to electrostatically destroy the IC chip 81.

When the cartridge body 27 is attached to the attachment portion 51 of the image forming station Pa, the cartridge body 27 is pressed by the distal end 52*a* of the step 52 whereby the engaging concave portion 78 disengages from the engaging convex portion 79 and the memory unit 60A is rotated by approximately 90 degrees. In this way, the electrode terminals 83*a* to 83*d* of the memory unit 60A can be electrically connected to the electrode terminals 53*a* of the connecting portion 53 of the attachment portion 51.

While embodiments of the present invention have been described, the present invention is not limited to the above-described embodiments. Moreover, the effects described in the embodiments of the present invention merely exemplify the most preferable effects obtained from the present invention, and the effects according to the present invention are not limited to those described in the embodiments of the present invention.

For example, although the first and second embodiments have been described by way of a configuration in which the cartridge body 27-side bearing is provided on the lower side 27*a*2 of the distal end surface 27*a* in the attachment direction C of the cartridge body 27 and the rotation shaft 75 of the memory unit 60 or 60A is attached to the bearing, the present invention is not limited to this configuration. For example, the cartridge body 27-side bearing may be provided in any one of the upper side 27*a*1, the lower side 22*a*2, the left side 22*a*3, and the right side 22*a*4 of the distal end surface 27*a* in the attachment direction C of the cartridge body 27, and the rotation shaft 75 may be attached to any one of the upper side 27*a*1, the lower side 22*a*2, the left side 22*a*3, and the right side 22*a*4 of the distal end surface 27*a* in the attachment direction C of the cartridge body 27. In this case, the arrangement positions of the connecting portion 53 and the step 52 in the attachment portion 51 may be changed depending on the attachment position of the memory unit 60 or 60A. For example, the attachment position of the rotation shaft 75 of the memory unit 60 or 60A may be standardized to the lower side for all toner cartridges 22*a* to 22*d*. However, the attachment position of the rotation shaft 75 of the memory unit 60 or 60A may be allocated to any one of the four sides (the upper side 27*a*1, the lower side 27*a*2, the left side 27*a*3, and the right side 27*a*4) for the respective toner colors. By allocating the attachment position of the memory unit 60 or 60A for the respective toner colors, it is possible to prevent attachment errors of the toner cartridges 22*a* to 22*d*, for example.

In the present embodiment, although the toner cartridges 22*a* to 22*d* were used as the cartridge, the present invention is not limited to this. For example, a developing cartridge, a photosensitive drum cartridge, or a process cartridge that integrates these cartridges may be used as the cartridge.

Although the present embodiment has been described by way of the image forming apparatus 100 of the electrophotographic system which includes the toner cartridges 22*a* to 22*d* that stores toner, the present invention is not limited to this. For example, an image forming apparatus of an inkjet system which has an ink cartridge that stores ink can be used as the image forming apparatus.

INDUSTRIAL APPLICABILITY

The present invention can be used in an image forming apparatus which uses cartridges. Moreover, the present invention can be used in an apparatus which uses cartridges, in addition to the image forming apparatus.

EXPLANATION OF REFERENCE NUMERALS

22*a*, 22*b*, 22*c*, 22*d*: Toner cartridge (Cartridge)
27: Cartridge body
51: Attachment portion
52: Step
53: Connecting portion
53*a*: Electrode terminal
60: Memory unit
70: Housing
80: Substrate member
81: IC chip
83: Electrode terminal portion
83*a*-83*d*: Electrode terminal
100: Image forming apparatus
101: Image forming apparatus body
Pa, Pb, Pc, Pd: Image forming station

What is claimed is:

1. A cartridge which stores an image forming material used for image formation and which is detachably attached to an image forming apparatus, comprising:

a cartridge body; and a memory unit which is rotatably attached to an attachment distal end of the cartridge body, wherein before the cartridge starts being inserted into an attachment portion of the image forming apparatus, at least whole of an electrode terminal portion of the memory unit is in a state of being protected from the outside by the attachment distal end of the cartridge body, after the cartridge is inserted into the attachment portion of the image forming apparatus, the memory unit rotates by a predetermined angle with respect to the cartridge body whereby the electrode terminal portion is exposed, and when the cartridge advances further into the attachment portion in a state where the electrode terminal portion is exposed, a first electrode terminal provided in the electrode terminal portion is electrically connected to at least a second electrode terminal provided in the attachment portion.

2. The cartridge according to claim 1, wherein at least a portion of the memory unit makes contact with at least a portion of the attachment portion whereby the memory unit rotates by the predetermined angle with respect to the cartridge body.

3. The cartridge according to claim 1, wherein the memory unit includes:

an IC chip that stores at least related information related to the cartridge body;

a substrate member having the electrode terminal portion and a circuit that connects the first electrode terminal provided in the electrode terminal portion and the IC chip mounted on the substrate member; and a housing on which the substrate member is mounted and which connects the memory unit to the cartridge body so as to be rotatable.

4. The cartridge according to claim 3, wherein the first electrode terminal provided in the electrode terminal portion includes a plurality of partial electrode terminals arranged on the substrate member, the plurality of partial electrode terminals are arranged at different positions in a direction crossing an insertion direction when the cartridge is attached to the image forming apparatus, and both sides in a longitudinal direction of each of the plurality of partial electrode terminals are parallel in the insertion direction when the cartridge is attached to the image forming apparatus.

5. The cartridge according to claim 3, wherein the housing includes:

a planar mounting portion on which the substrate member is mounted;

a rib provided on an outer edge of the planer mounting portion and having at least a function of aligning the substrate member; and a memory unit-side rolling bearing provided on the rib, and the cartridge includes:

a cartridge-side rolling bearing provided on an edge of a front end surface in the insertion direction of the cartridge body;

a rotation shaft corresponding to the memory unit-side rolling bearing and the cartridge-side rolling bearing; and a biasing member for biasing the memory unit in a direction in which at least the electrode terminal portion of the memory unit that has become rotatable in relation to the cartridge body with the aid of the memory unit-side rolling bearing, the cartridge-side rolling bearing, and the rotation shaft is protected from the outside by the attachment distal end of the cartridge body.

6. The cartridge according to claim 5, wherein the memory unit is attached to the cartridge body so that an end of the housing protrudes from the attachment distal end of the cartridge body, and in a period in which the cartridge is inserted into the attachment portion to attach the cartridge to the image forming apparatus, the electrode terminal portion of the memory unit is rotated up to the predetermined angle by a force that the end of the housing receives from the attachment portion while resisting a biasing force of the biasing member.

7. The cartridge according to claim 3, the housing includes:

a planar mounting portion on which the substrate member is mounted;

a rib provided on an outer edge of the planer mounting portion and having at least a function of aligning the substrate member; and a memory unit-side rolling bearing provided on the rib, and the cartridge includes:

a cartridge-side rolling bearing provided on an edge of a front end surface in the insertion direction of the cartridge body;

a rotation shaft corresponding to the memory unit-side rolling bearing and the cartridge-side rolling bearing; and a locking portion for locking the memory unit to the cartridge body so that at least the electrode terminal portion of the memory unit that has become rotatable in relation to the cartridge body with the aid of the memory unit-side rolling bearing, the cartridge-side rolling bearing, and the rotation shaft is protected from the outside by the attachment distal end of the cartridge body.

8. The cartridge according to claim 7, wherein the locking portion includes:

a first locking portion provided in the housing; and a second locking portion provided in the cartridge body, and the first locking portion and the second locking portion engage with each other whereby the memory unit is locked to the cartridge body.

9. The cartridge according to claim 7, wherein the memory unit is attached to the cartridge body so that an end of the housing protrudes from the attachment distal end of the cartridge body, and in a period in which the cartridge is inserted into the attachment portion to attach the cartridge to the image forming apparatus, the electrode terminal portion of the memory unit is rotated up to the predetermined angle by a force that the end of the housing receives from the attachment portion.

10. The cartridge according to claim 1, wherein the cartridge body is formed in an approximately rectangular parallelepiped shape, and the memory unit is attached to any one of the four sides of a surface of the attachment distal end of the cartridge body.

11. The cartridge according to claim 10, wherein the side to which the memory unit is attached is different depending on a type of the image forming material.

12. An image forming apparatus comprising:

the cartridge according to claim 1;

the attachment portion which has the second electrode terminal electrically connected at least to the first electrode terminal provided in the electrode terminal portion when the cartridge is inserted into the attachment portion in a state in which the memory unit is rotated by the predetermined angle with respect to the cartridge body and which is configured so that the cartridge is detachably attached to the attachment portion; and an image forming unit for forming an image.

* * * * *